US009407004B2

(12) United States Patent
Bishop et al.

(10) Patent No.: US 9,407,004 B2
(45) Date of Patent: Aug. 2, 2016

(54) MULTI-ELEMENT OMNI-DIRECTIONAL ANTENNA

(75) Inventors: Bruce Foster Bishop, Aptos, CA (US); Luis Cardenas, Watsonville, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 733 days.

(21) Appl. No.: 13/557,483

(22) Filed: Jul. 25, 2012

(65) Prior Publication Data

US 2014/0030989 A1 Jan. 30, 2014

(51) Int. Cl.
*H01Q 1/48* (2006.01)
*H01Q 1/52* (2006.01)
*H01Q 21/28* (2006.01)

(52) U.S. Cl.
CPC ..... *H01Q 1/521* (2013.01); *H01Q 21/28* (2013.01)

(58) Field of Classification Search
CPC ..... H01Q 21/28
See application file for complete search history.

(56) References Cited

U.S. PATENT DOCUMENTS 4,581,496 A * 4/1986 Sweany ..... 381/429
6,339,407 B1 * 1/2002 Gabriel et al. ..... 343/797
6,362,789 B1 3/2002 Trumbull et al.
6,414,637 B2 7/2002 Keilen
6,515,627 B2 2/2003 Lopez et al.
7,592,957 B2 9/2009 Achour et al.
7,764,232 B2 7/2010 Achour et al.
7,847,739 B2 12/2010 Achour et al.
7,855,696 B2 12/2010 Gummalla et al.
8,624,792 B2 * 1/2014 Popugaev ..... 29/600
2005/0017911 A1 1/2005 Lee
2005/0116866 A1 6/2005 Lin et al.
2005/0156784 A1 * 7/2005 Ryken, Jr. ..... H01Q 9/0442 343/700 MS
2005/0212161 A1 9/2005 Aisenbrey
2005/0264469 A1 12/2005 Nowotarski
2006/0042076 A1 3/2006 Previti
2006/0273965 A1 12/2006 Gat et al.
2007/0146226 A1 6/2007 Oh et al.
2007/0205947 A1 * 9/2007 Boyle ..... 343/700 MS
2008/0068216 A1 3/2008 Borisov et al.
2008/0094302 A1 * 4/2008 Murch et al. ..... 343/846
2008/0204347 A1 * 8/2008 Alvey et al. ..... 343/841
2009/0146895 A1 6/2009 Drexler et al.
2009/0224995 A1 * 9/2009 Puente et al. ..... 343/850
2009/0237307 A1 9/2009 Tsai et al.
2009/0322648 A1 12/2009 Bishop et al.
2010/0097284 A1 4/2010 Brannan et al.
2010/0164830 A1 * 7/2010 Huang et al. ..... 343/846
2010/0238072 A1 * 9/2010 Ayatollahi ..... H01Q 1/243 343/700 MS
2011/0169703 A1 * 7/2011 Schlub et al. ..... 343/702
2012/0068905 A1 * 3/2012 Ayatollahi et al. ..... 343/841
2012/0139806 A1 * 6/2012 Zhan ..... H01Q 1/48 343/770
2012/0274522 A1 * 11/2012 Ayatollahi ..... H01Q 1/243 343/745
2012/0329523 A1 * 12/2012 Stewart et al. ..... 455/562.1
2013/0187825 A1 * 7/2013 Andujar Linares et al. .. 343/853
2014/0024462 A1 * 1/2014 Qiang et al. ..... 463/42

* cited by examiner

*Primary Examiner* — Trinh Dinh

(57) ABSTRACT

An antenna circuit board assembly comprises a substrate having a ground plane comprised of a conductive material; a first antenna element mounted to the substrate and coupled to the ground plane; a second antenna element mounted to the substrate and coupled to the ground plane; a third antenna element mounted to the substrate and coupled to the ground plane; and a plurality of features etched into the ground plane, each of the plurality of features having a respective length and a respective width. The respective length and the respective width of each of the plurality of features are selected to increase isolation between the first, second, and third antenna elements.

30 Claims, 20 Drawing Sheets

Legend
704.00(MHz)
740.00(MHz)
756.00(MHz)
787.00(MHz)
824.00(MHz)
880.00(MHz)
894.00(MHz)
920.00(MHz)
940.00(MHz)
1710.00(MHz)
1785.00(MHz)
1850.00(MHz)
1880.00(MHz)
1920.00(MHz)
1990.00(MHz)
2010.00(MHz)
2110.00(MHz)
2140.00(MHz)

Legend
704.00(MHz)
740.00(MHz)
756.00(MHz)
787.00(MHz)
824.00(MHz)
880.00(MHz)
894.00(MHz)
920.00(MHz)
940.00(MHz)
1710.00(MHz)
1785.00(MHz)
1850.00(MHz)
1880.00(MHz)
1920.00(MHz)
1990.00(MHz)
2010.00(MHz)
2110.00(MHz)
2140.00(MHz)

MULTI-ELEMENT OMNI-DIRECTIONAL ANTENNA

BACKGROUND

With the recent development of new technologies, such as 4G LTE, it is desirable for an antenna to cover a broad frequency bandwidth in a small physical antenna volume. If an antenna enclosure includes multiple antennas, it is also desirable to have adequate isolation between any two antennas operating in the same frequency range.

SUMMARY

In one embodiment, an antenna circuit board assembly is provided. The antenna circuit board assembly comprises a substrate having a ground plane comprised of a conductive material; a first antenna element mounted to the substrate and coupled to the ground plane; a second antenna element mounted to the substrate and coupled to the ground plane; a third antenna element mounted to the substrate and coupled to the ground plane; and a plurality of features etched into the ground plane, each of the plurality of features having a respective length and a respective width. The respective length and the respective width of each of the plurality of features are selected to increase isolation between the first, second, and third antenna elements.

DRAWINGS

Understanding that the drawings depict only exemplary embodiments and are not therefore to be considered limiting in scope, the exemplary embodiments will be described with additional specificity and detail through the use of the accompanying drawings, in which.

Figure 1:
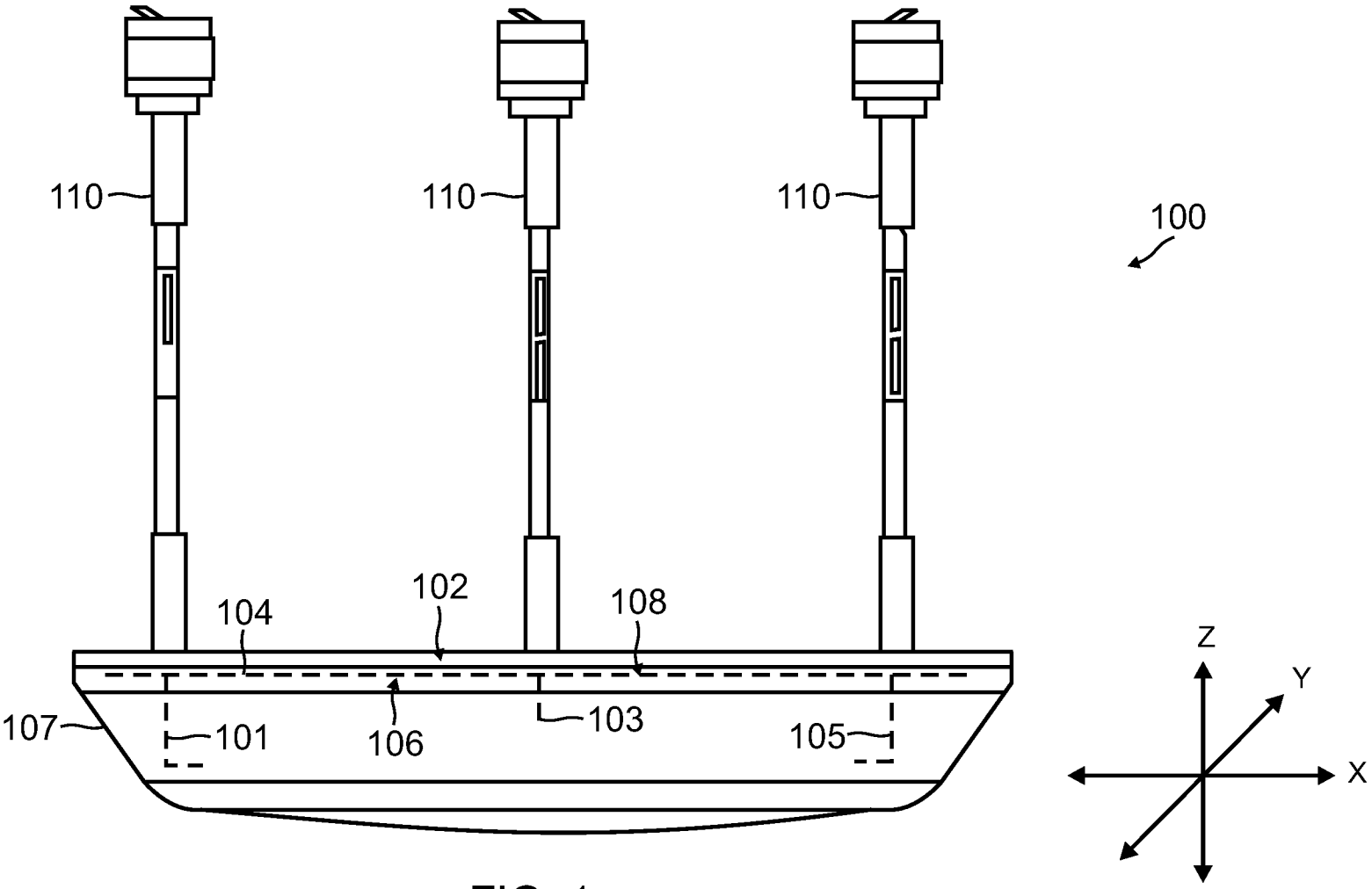
FIG. 1 is a side view of one embodiment of an antenna assembly.

In accordance with common practice, the various described features are not drawn to scale but are drawn to emphasize specific features relevant to the exemplary embodiments.

DETAILED DESCRIPTION

In the following detailed description, reference is made to the accompanying drawings that form a part hereof, and in which is shown by way of illustration specific illustrative embodiments. However, it is to be understood that other embodiments may be utilized and that logical, mechanical, and electrical changes may be made. Furthermore, the method presented in the drawing figures and the specification is not to be construed as limiting the order in which the individual steps may be performed. The following detailed description is, therefore, not to be taken in a limiting sense.

FIG. 1 is a side view of one embodiment of an antenna assembly 100. The antenna assembly 100 includes a circuit board assembly 102, a housing 107, and a plurality of wires 110. The circuit board assembly 102 is located inside the housing 107, as indicated by the dashed lines. The circuit board assembly 102 includes a plurality of antenna elements 101, 103, and 105 mounted to a substrate 104, which is also referred to herein as a circuit board 104. The circuit board 104 includes an antenna side 106 to which the antenna elements 101, 103, and 105 are mounted. The circuit board 104 also includes a cable side 108 to which the wires or cables 110, which connect to the antenna elements 101, 103, and 105, are terminated. In addition, the circuit board 104 includes a ground plane and the antenna elements 101, 103, and 105 are grounded to the common ground plane of the circuit board 104.

The antenna elements 101, 103, and 105 are each designed to receive electromagnetic waves, and are particularly designed and/or dimensioned (e.g. sized and shaped) to operate (i.e. radiate electromagnetic waves) within one or more selected frequency ranges. The antenna elements 101 and 105 are approximately identical, in this embodiment, in terms of shape, size, and material. Antenna element 103, on the other hand, differs from antenna elements 101 and 105 at least in terms of size and shape. Thus, in this embodiment, antenna elements 101 and 105 are configured to operate over the same frequency ranges whereas antenna element 103 is configured to operate over at least one frequency range that differs from the corresponding frequency ranges of antenna elements 101 and 105. For example, antenna elements 101 and 105 are configured, in one embodiment, to operate over the frequency ranges 698-960 MHz and 1710-2170 MHz and antennal element 103 is configured to operate over the frequency ranges 1710-2170 MHz and 2496-2690 MHz.

Another example of a design characteristic of the antenna elements 101, 103, and 105 is the type of material used to manufacture the antenna elements 101, 103, and 105. In an exemplary embodiment, the antenna elements 101, 103, and 105 are manufactured from a metal material, such as copper or a steel material. Optionally, the material may be a cold rolled steel material. The antenna elements 101, 103, and 105 may also be finished with a coating or plating, such as tin plating or another type of plating or coating that enhances electrical performance or characteristics. Additionally, the antenna elements 101, 103, and 105 are selectively finished in predetermined areas of the antenna element, in some embodiments. The antenna elements 101, 103, and 105 can all be manufactured from the same or different materials.

Figure 6:
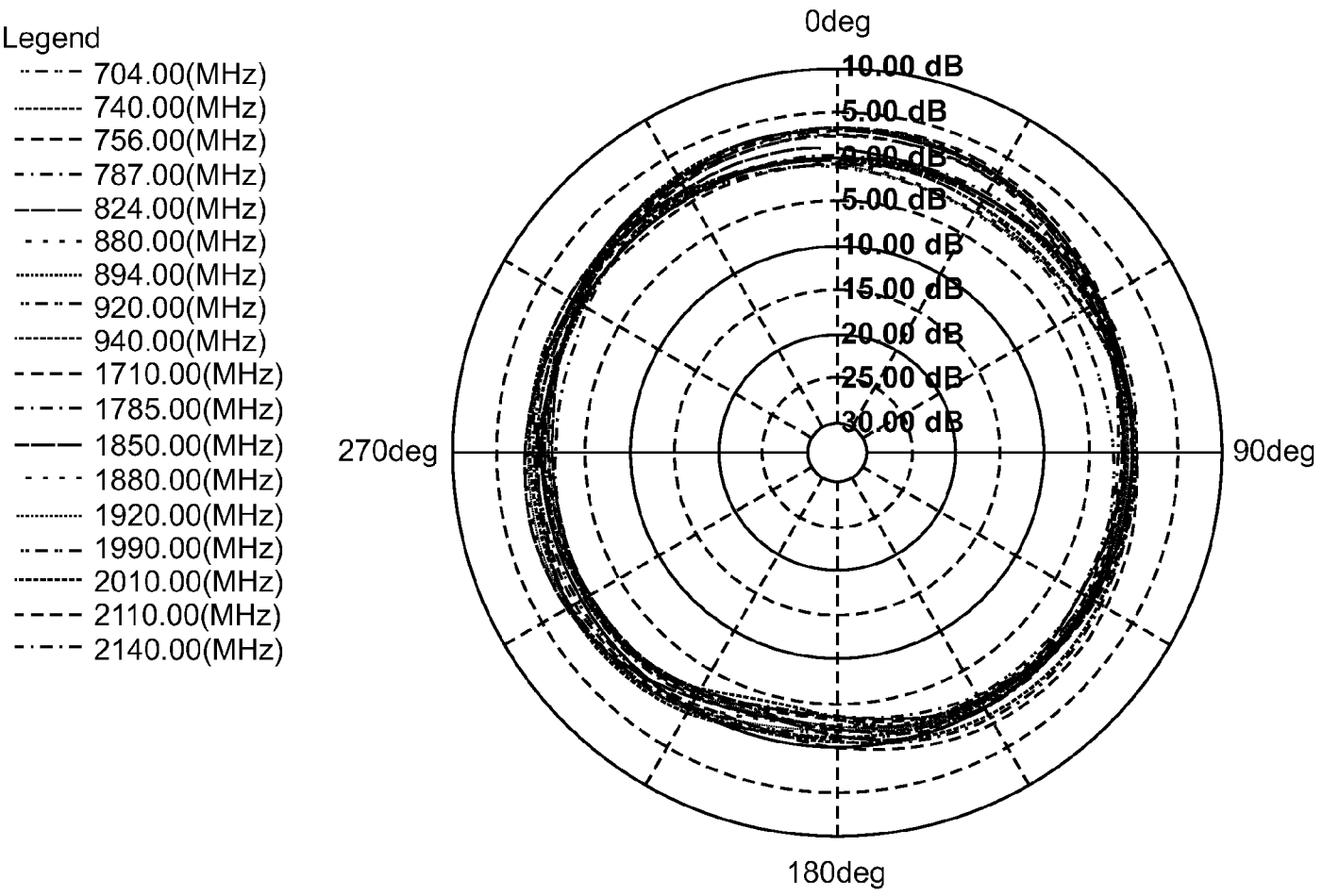
FIGS. 6-14 are graphs depicting exemplary measured directional patterns, as a function of both frequency and angle, of an exemplary antenna assembly.
Figure 7:
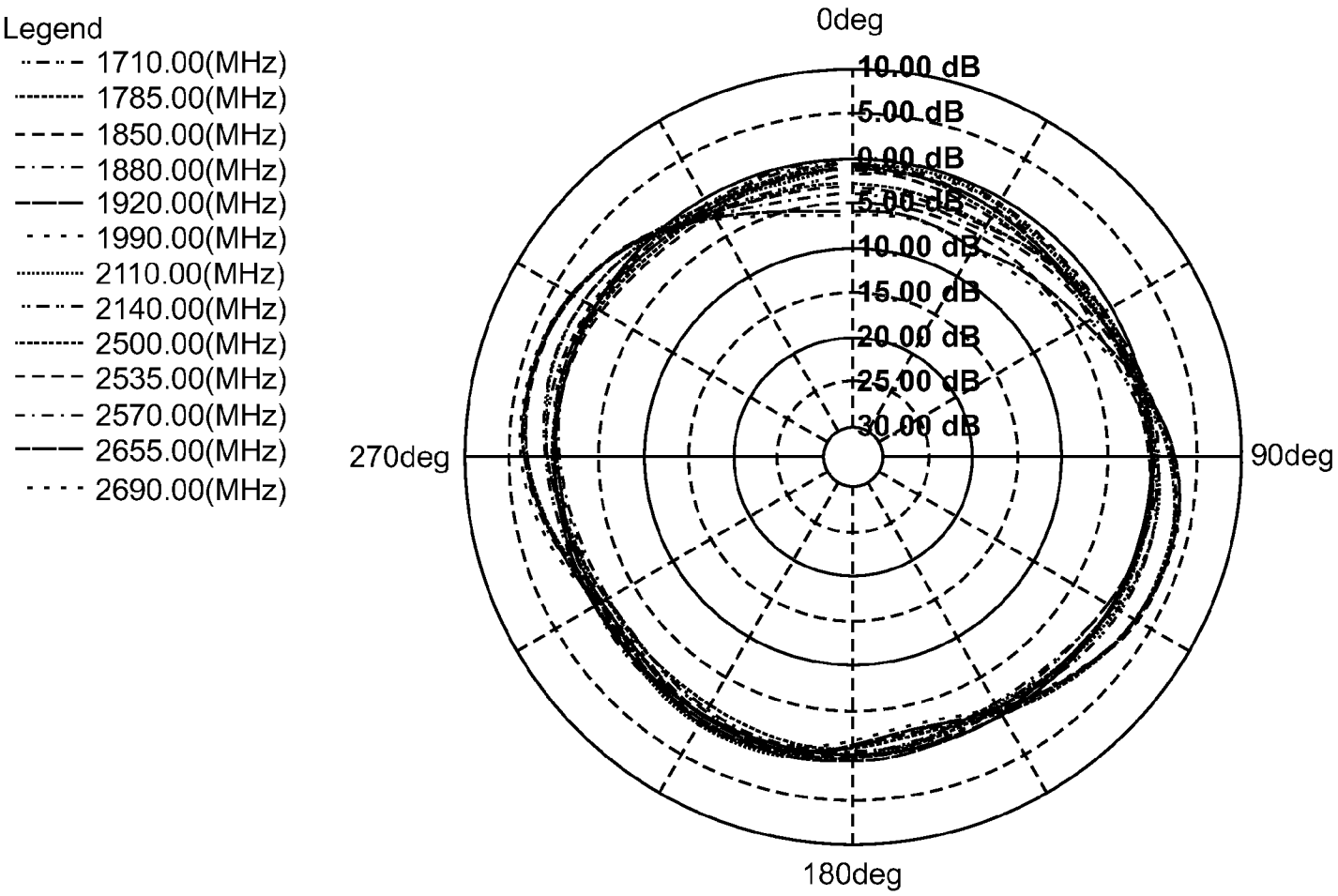
Figure 8:
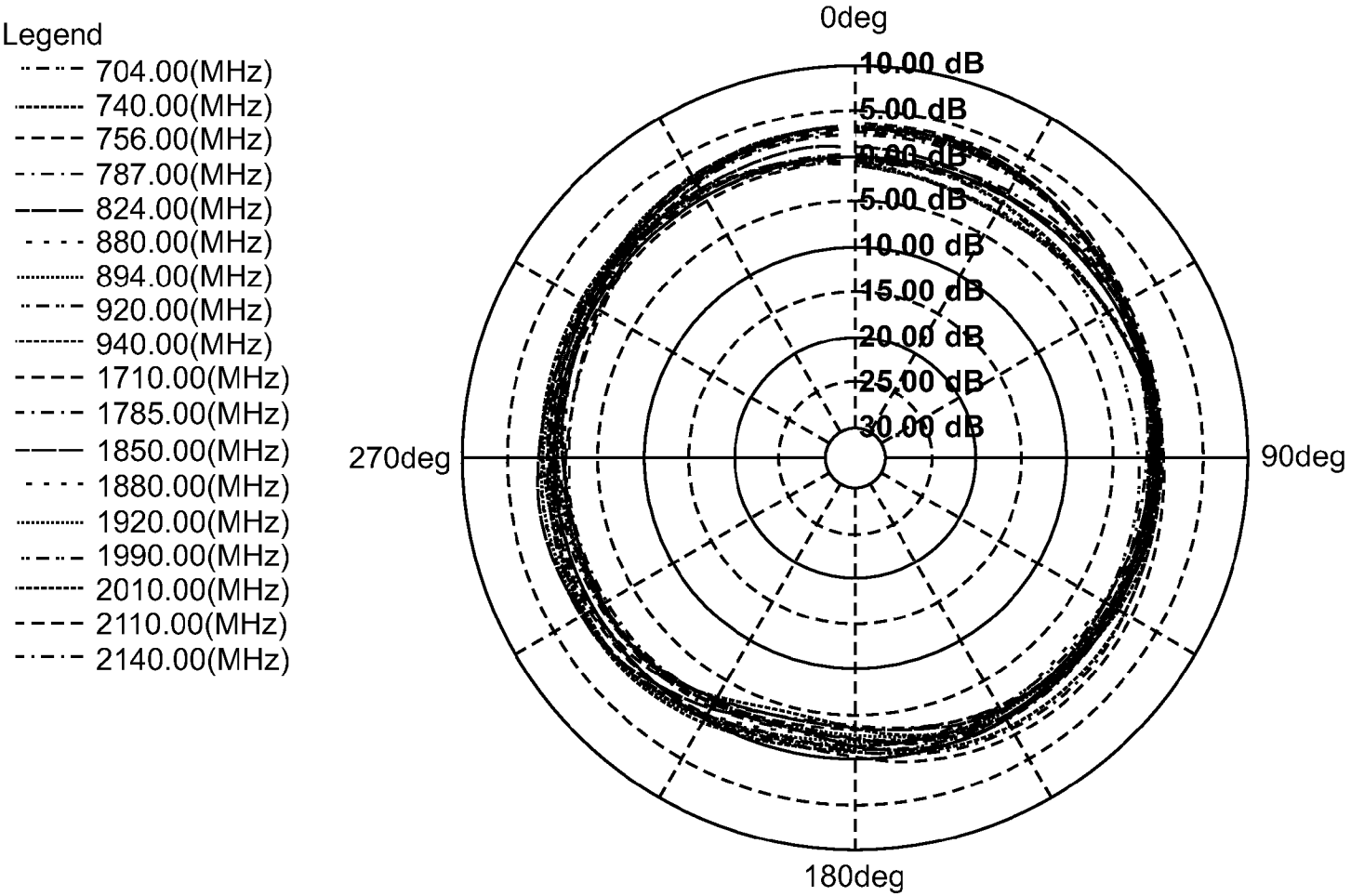
Figure 9:
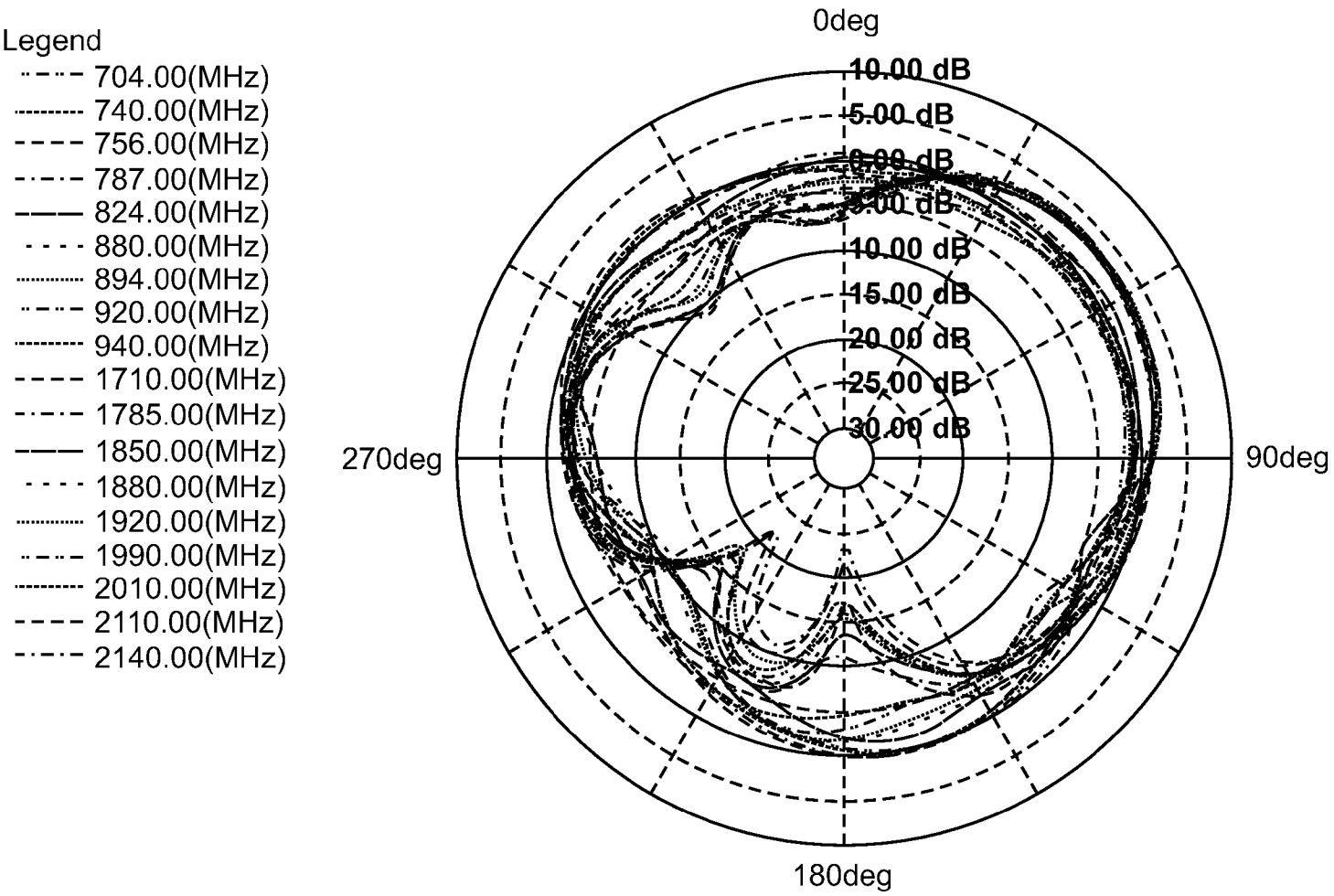
Figure 10:
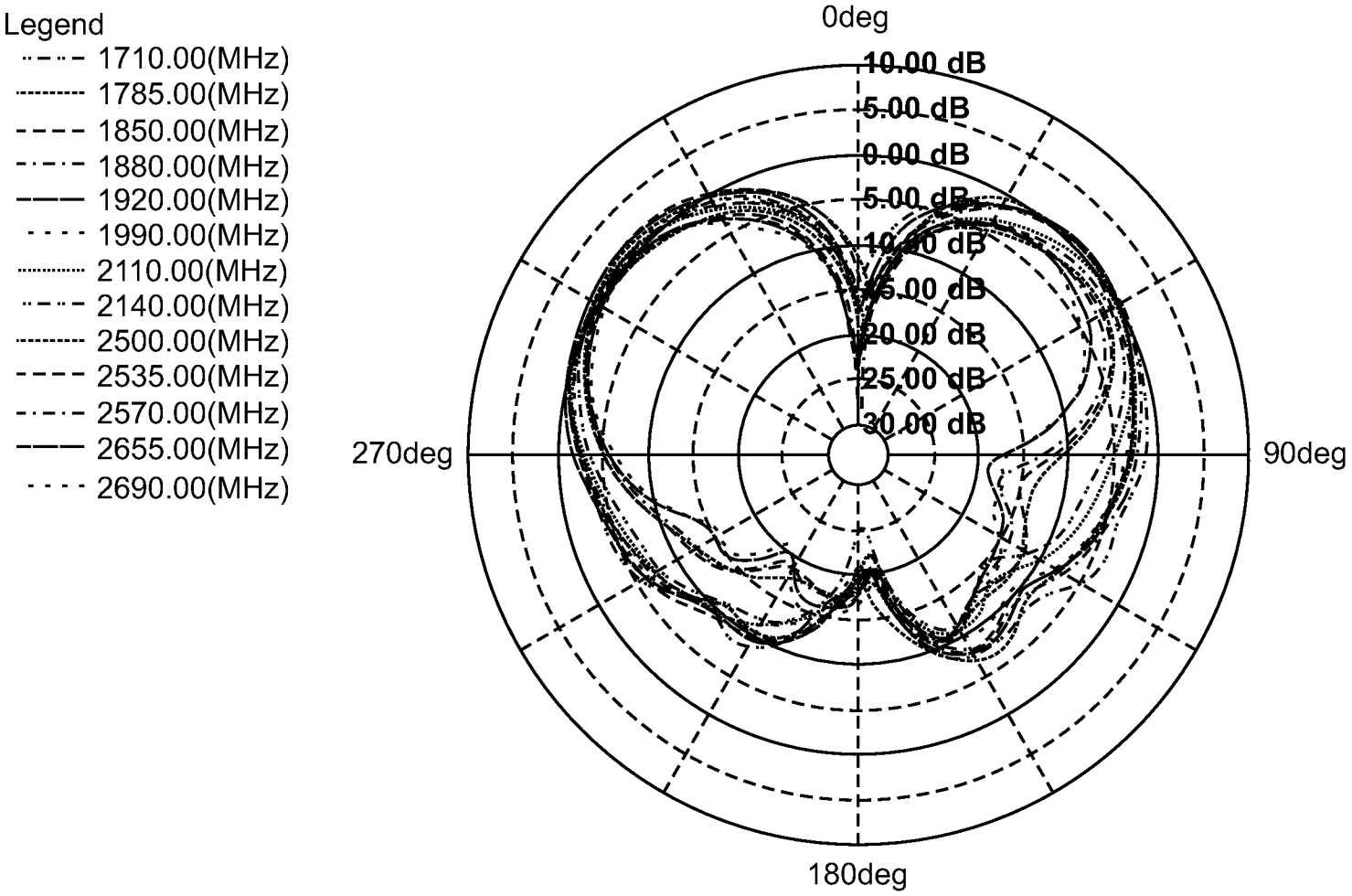
Figure 11:
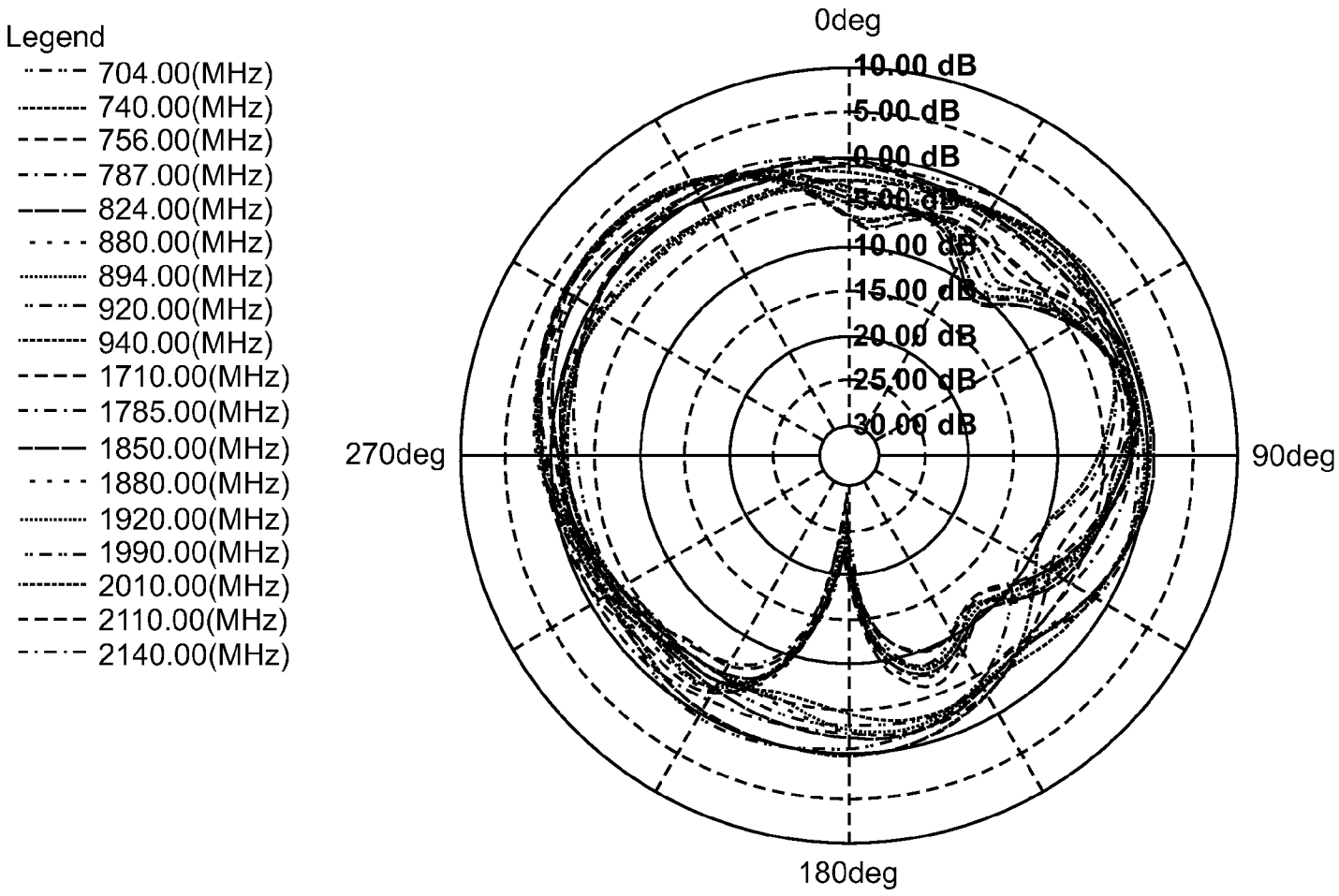
Figure 12:
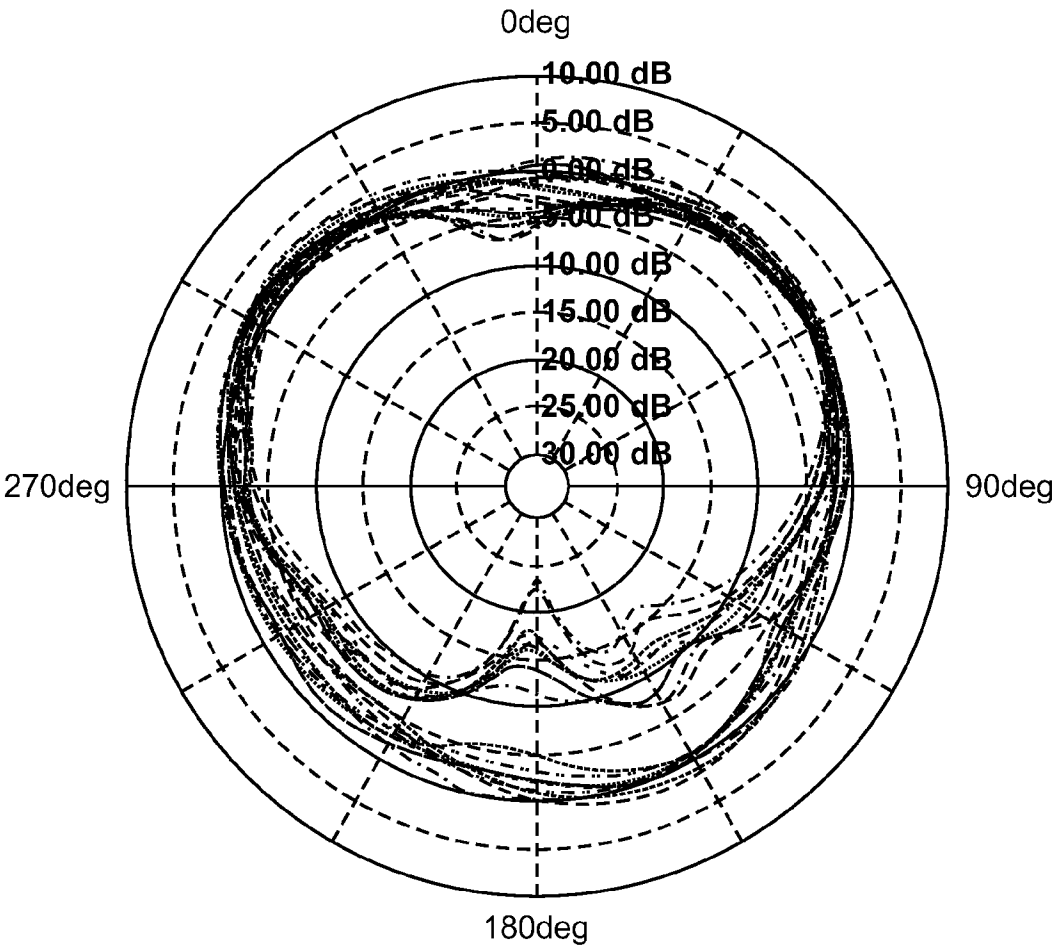
Figure 13:
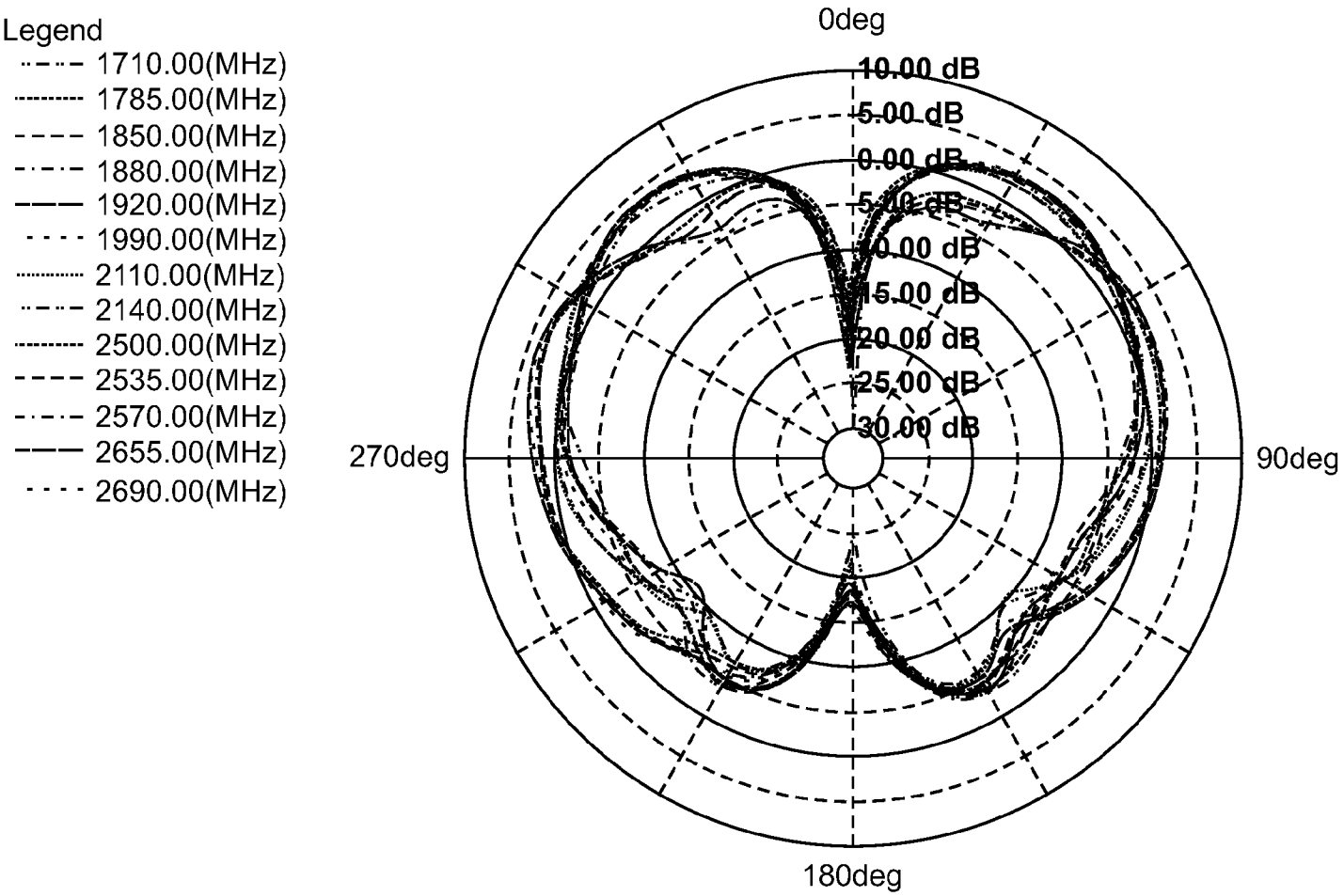
Figure 14:
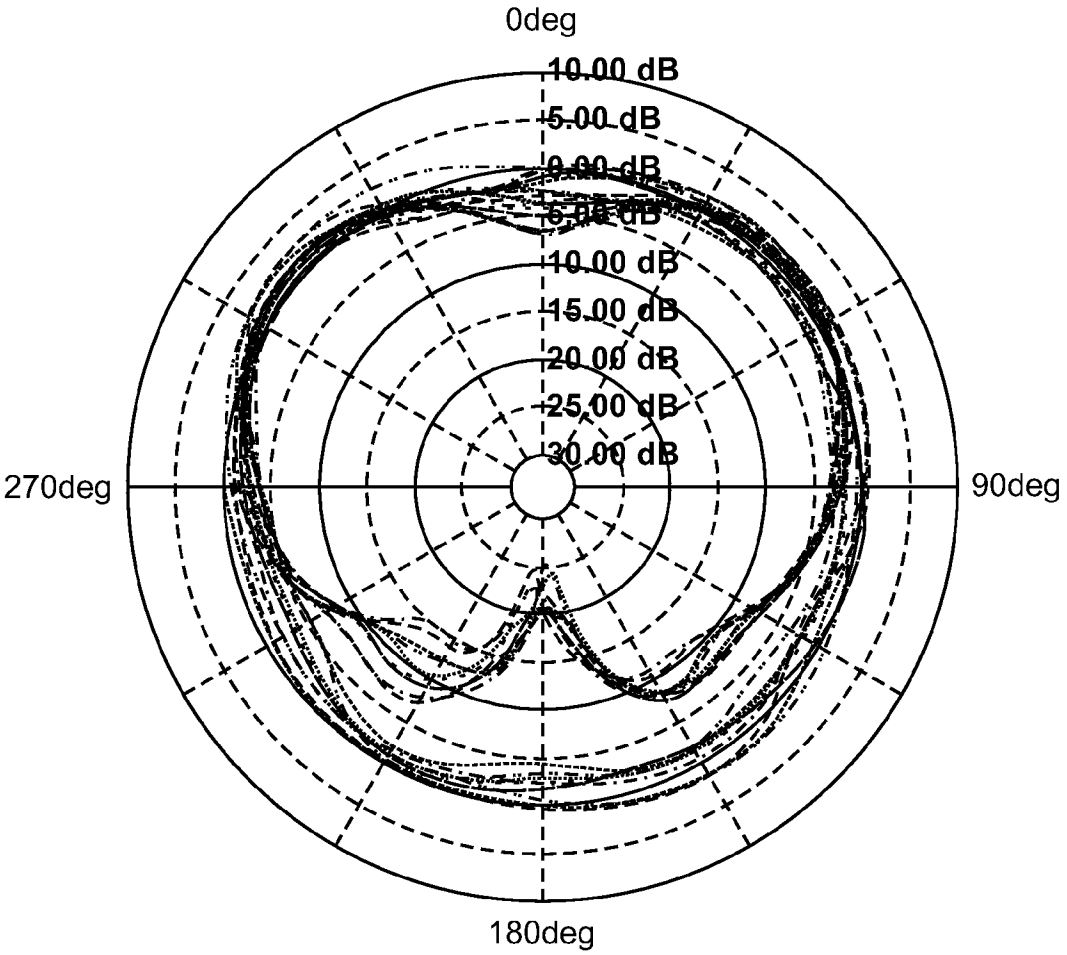

The antenna elements 101, 103, and 105 are configured to provide hemispherical coverage in directions radially outward from the housing 107. For example, FIGS. 6-14 are graphs depicting exemplary measured directional patterns, as a function of both frequency and angle. In particular, FIGS. 6-8 depict exemplary measured directional patterns in a first plane, defined by the X and Y axes, for antenna elements 101, 103, and 105, respectively. FIGS. 9-11 depict exemplary measured directional patterns in a second plane, defined by the Y and Z axes, for antenna elements 101, 103, and 105, respectively. FIGS. 12-14 depict exemplary measured directional patterns in a third plane, defined by the X and Z axes, for antenna elements 101, 103, and 105, respectively.

Figure 2B:
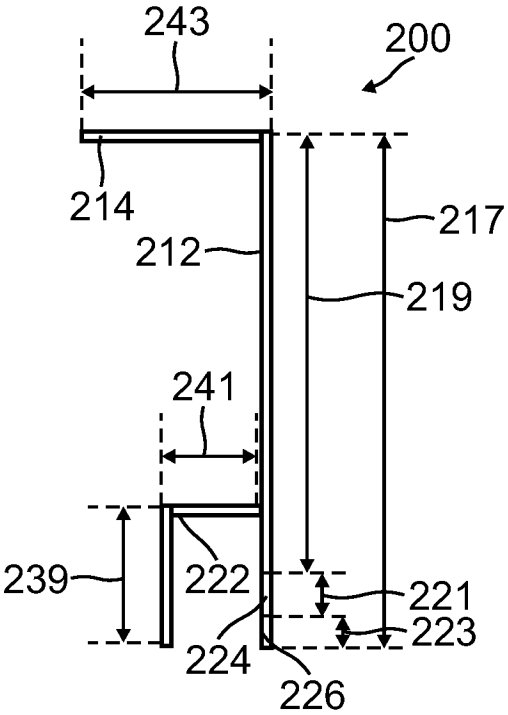
FIGS. 2A and 2B depict a front view and a side view, respectively, of an exemplary antenna element.
Figure 2A:
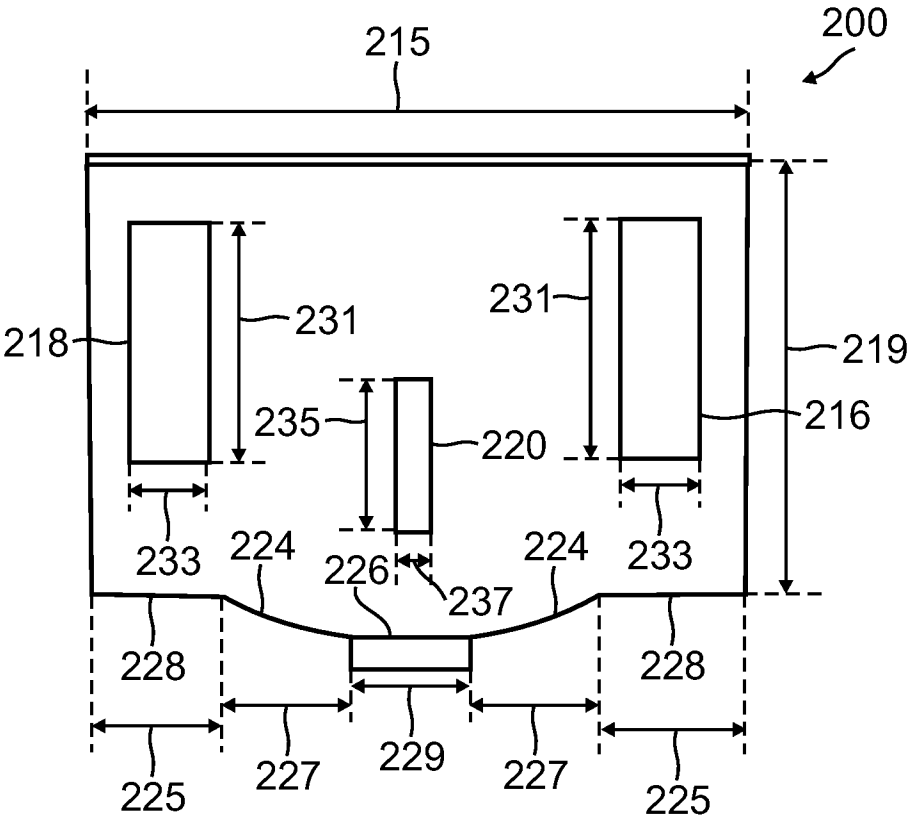

FIGS. 2A and 2B depict a front view and a side view, respectively, of an exemplary antenna element 200 which can be implemented as antenna elements 101 and 105 in the antenna assembly 100 above. Antenna element 200 includes a first portion 212 having a length 217 that extends along a first plane and a second portion 214 having a length 243 that extends from the first portion 212 along a second plane that is transverse to the first plane. The first portion 212 and second portion 214 can be stamped from a stock material and formed by bending the antenna element 200 at a bend line where the first portion 212 and the second portion 214 meet. The first portion 212 and the second portion 214 each have a width 215. In one embodiment, the length 217 is approximately 60 mm, the length 243 is approximately 10 mm, and the width 215 is approximately 65 mm.

When mounted on a circuit board, such as circuit board 104, the first portion 212 extends generally perpendicularly from the circuit board and has a generally vertical orientation when the antenna assembly, e.g. antenna assembly 100, is resting on a horizontal surface, such as a desk, a table or a floor of a building in typical applications. The second portion 214 extends generally perpendicularly from the first portion 212 such that the antenna element 200 defines an approximate right angle or orthogonal antenna element. The second portion 114 has a generally horizontal orientation when the antenna assembly is resting on a horizontal surface.

In this embodiment, the first portion 212 also includes a mounting section 226 having a width 229 and a height 223, tapered sections 224 each having a height 221 and a width 227 on either side of the mounting section 226, and flat sections 228 each having a width 235 on the outside of the tapered sections 224. The first portion 212 has a length 219 which extends from the flat sections 228 to the top of the first portion 212 where the first portion 212 and the second portion 214 meet. The mounting section 226 is placed in contact with and bonded to a mounting pad to couple the antenna element 200 to the circuit board.

In addition, in the exemplary embodiment of FIG. 2, the first portion 212 includes a plurality of slots 216, 218, and 220. The slots 216 and 218 each have a width 233 and a height 231. The slot 220 has a width 237 and a height 235. The respective width and height of the slots 216, 218, and 220 are selected to control an impedance of the antenna element 200. Additionally, the length 217 and width 215 of the first portion 212 can be selected to tune the antenna element 200 in some embodiments. It is to be understood that the characteristics of the slots 216, 218, and 220 are dependent on the desired impedance of the antenna element. Hence, the size, location and number of slots can vary in other embodiments based on the desired impedance.

The antenna element 200 also includes an extension 222. The extension is bent, in this example, to form an approximate right angle. The extension 222 has a length 241 that extends from the first portion 212 below the slot 220. The extension 222 has a height 239 sufficient to contact a circuit board and is connected to the ground plane (e.g. ground plane 420 in FIG. 4D) via a mounting pad (e.g. mounting pad 407 in FIG. 4A). The width of the extension 222 is less than the width 237 of the slot 222 in this example. The length and width of extension 222 aids in controlling the impedance of the antenna element 200.

Figure 3B:
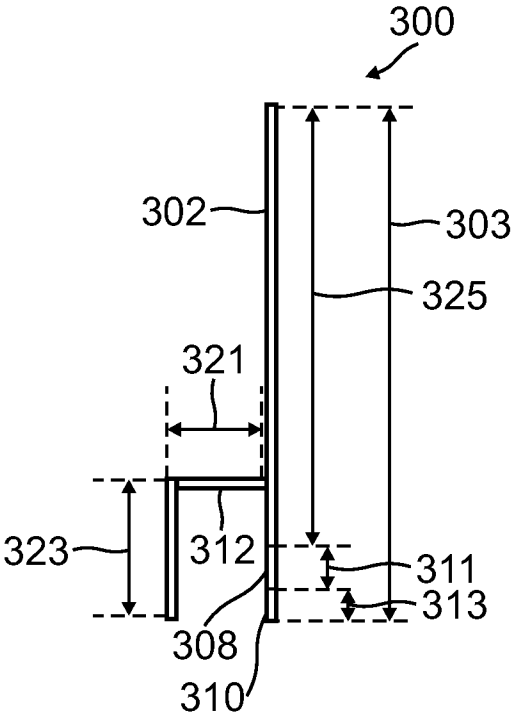
FIGS. 3A and 3B depict a front view and a side view, respectively, of another exemplary antenna element.
Figure 3A:
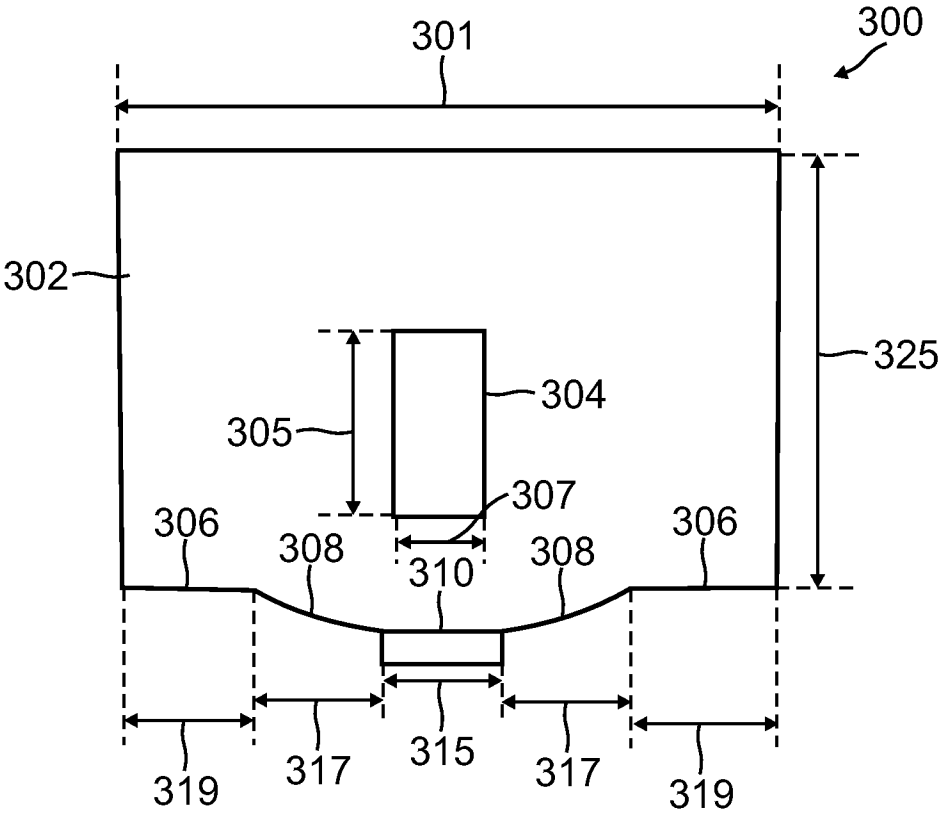

FIGS. 3A and 3B depict a front view and a side view, respectively, of another exemplary antenna element 300 which can be implemented as antenna element 103 in the antenna assembly 100 above. Unlike antenna element 200, antenna element 300 is not bent to form first and second portions. Rather, antenna element 300 includes a single portion 302 having a width 301 and a length 303. In one embodiment, the width 301 is approximately 32 mm and the length 303 is approximately 35 mm. When mounted on a circuit board, the length 303 extends generally perpendicularly from a circuit board and has a generally vertical orientation when the antenna assembly, e.g. antenna assembly 100, is resting on a horizontal surface, such as a desk, a table or a floor of a building in typical applications In addition, the portion 302 includes a single slot 304 in this example. The slot 304 has a width 307 and height 305. The width 307 and height 305 are selected to control an impedance of the antenna element 300. Additionally, the length 303 and width 301 of the portion 302 can be selected to tune the antenna element 300 in some embodiments.

The antenna element 300 also includes a mounting section 310 having a width 315 and a height 313, tapered sections 308 each having a height 311 and a width 317 on either side of the mounting section 310, and flat sections 306 each having a width 319 on the outside of the tapered sections 308. The portion 302 has a length 325 which extends from the flat sections 306 to the top of the antenna element 302. The mounting section 310 is placed in contact with and bonded to a mounting pad to couple the antenna element 300 to the circuit board.

The antenna element 300 also includes an extension 312 having a length 321 and a height 323. The extension is bent to form an approximately right angle. The height 323 is selected such that the extension contacts and is bonded to the circuit board. The shape and size of the antenna elements 200 and 300 enable a broader frequency range in a low profile (e.g. small size) assembly than available in conventional antenna assemblies.

Figure 4A:
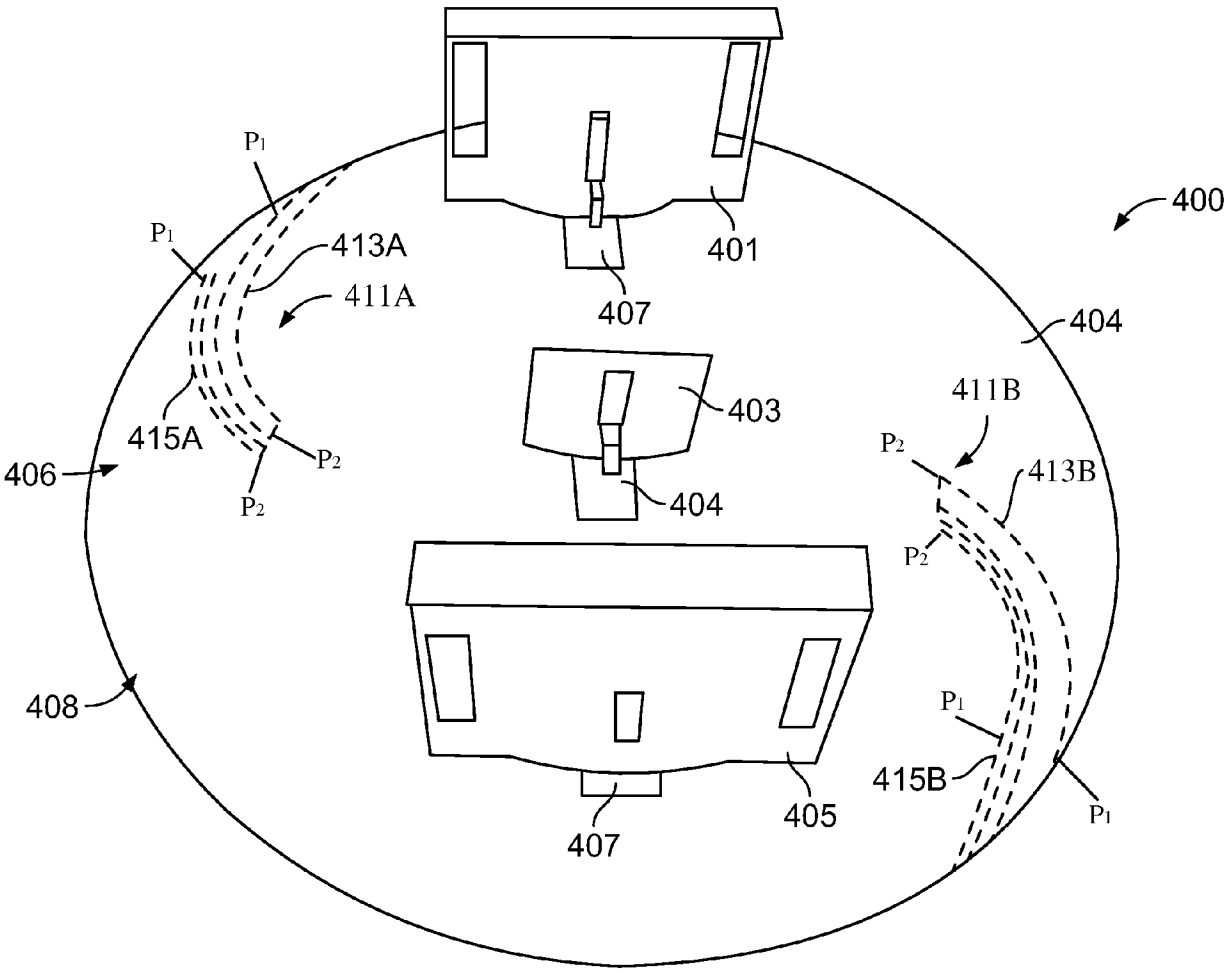
FIGS. 4A-4D depict views of an exemplary antenna circuit board assembly.
Figure 4B:
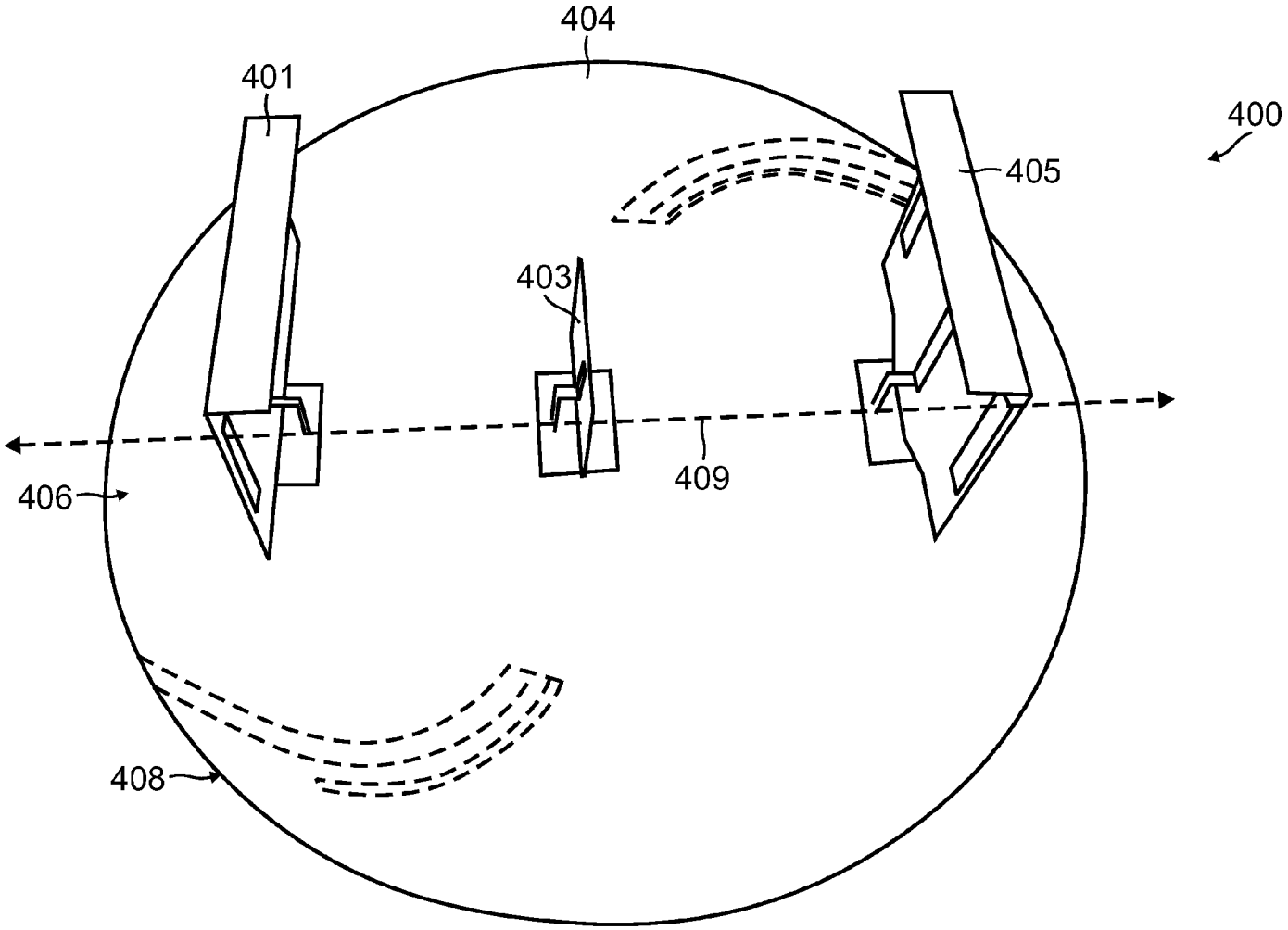
Figure 4C:
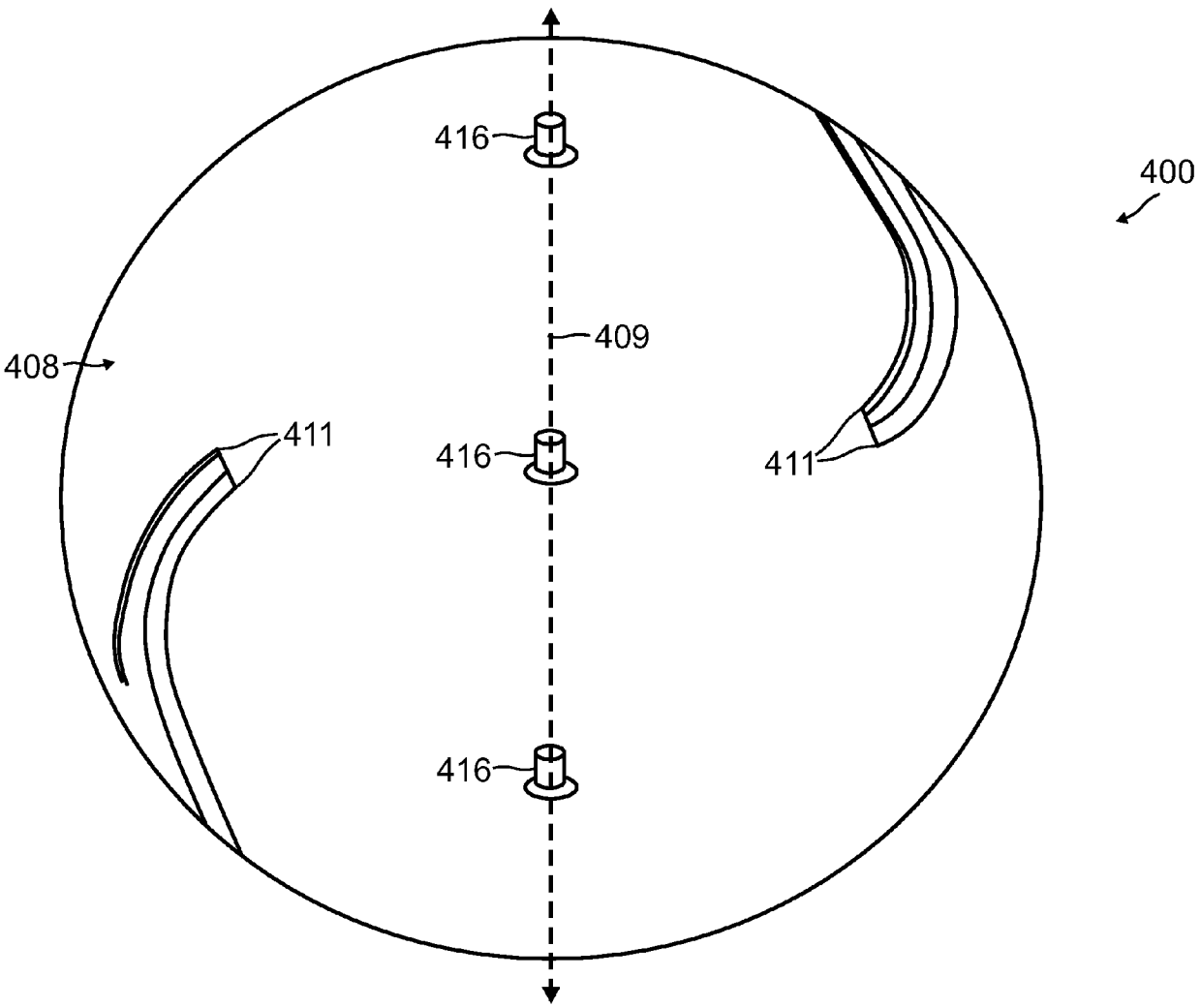
Figure 4D:
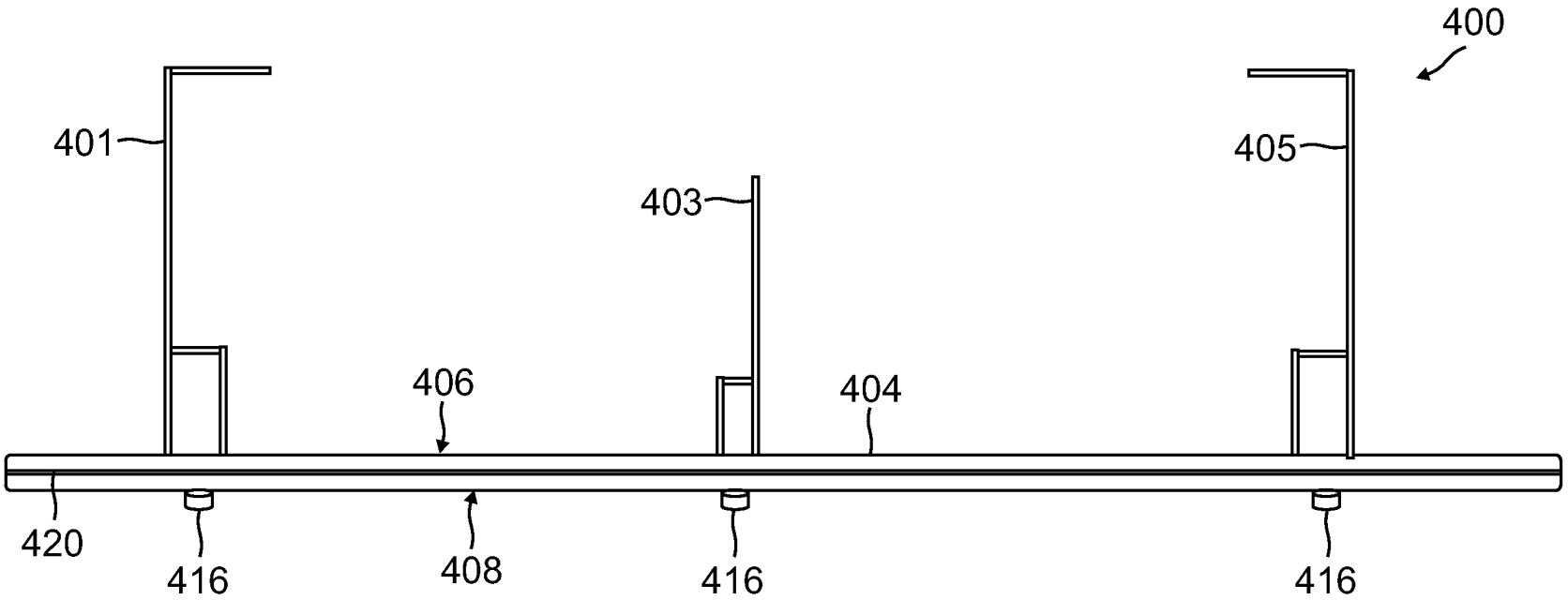

An exemplary antenna circuit board assembly 400 which includes antenna elements, such as antenna elements 200 and 300, is shown in FIGS. 4A-4D. In particular, FIGS. 4A and 4B depict top perspective views of the exemplary antenna circuit board assembly 400. FIG. 4C depicts a bottom view of the exemplary antenna circuit board assembly 400. FIG. 4D depicts a side view of the exemplary antenna circuit board assembly 400.

The antenna circuit board assembly 400 includes a plurality of antenna elements 401, 403, and 405 which correspond to antenna elements 101, 103, and 105 in the exemplary antenna assembly 100 discussed above. Antenna elements 401, 403, and 405 are mounted to respective mounting pads 407 on an antenna side 406 of the circuit board 404. As shown in FIGS. 4A-4C, the circuit board 404 has a circular shape in this embodiment. However, other shapes can be used in other embodiments. In addition, in this example, the antenna elements 401, 403, and 405 are mounted along a line 409 which approximately divides the circuit board 404 in half. In particular, the antenna element 403, which is smaller than antenna elements 401 and 405, is located approximately in the center of the circuit board 404. Antenna elements 401 and 405, which are approximately identical in size and shape, are located on either side of the antenna element 403 along the line 409. Each of antenna elements 401 and 405 are oriented such that the second portion 414 extends toward the center of the circuit board 404.

In addition, the circuit board 404 includes a plurality of features 411 etched into the ground plane 420 on the cable side 408 of the circuit board 404. The features 411 are depicted as dashed lines in FIGS. 4A and 4B to indicate the presence of the features 411 on the bottom or cable side 408. FIG. 4C is a view of the cable side 408 which depicts the features 411 and the cable connectors 416 for each of the respective antenna elements 401, 403, and 405. Etching the features 411 removes the conductive material from the conductive ground plane 420. For example, the ground plane 420 can be formed from a layer of copper in some embodiments. Portions of the copper are removed in predetermined patterns to form the features 411.

The features 411 improve isolation between antenna elements operating in the same frequency range. For example, as noted above, in some embodiments, antenna elements 401 and 405 are configured to operate over the frequency ranges 698-960 MHz and 1710-2170 MHz, and antennal element 403 is configured to operate over the frequency ranges 1710-2170 MHz and 2496-2690 MHz. Hence, the features 411 improve isolation between the antenna elements 401, 403, and 405.

Each of the features 411 begins on an edge of the circuit board 404 and extends toward the center of the circuit board. The length of the features 411 is dependent on the wavelength of the operation frequency of the antenna elements. In particular, the length of the features 411 is ¼ of the corresponding wavelength. In addition, each of the features 411 is curved. The curvature of the features 411 is dependent on the selected length of the feature 411 (e.g. ¼ wavelength of the frequency) and the size of the circuit board 404. In particular, the curvature is selected such that the etched features 411 have the desired length but do not divide the circuit board 411 in half.

Figure 15:
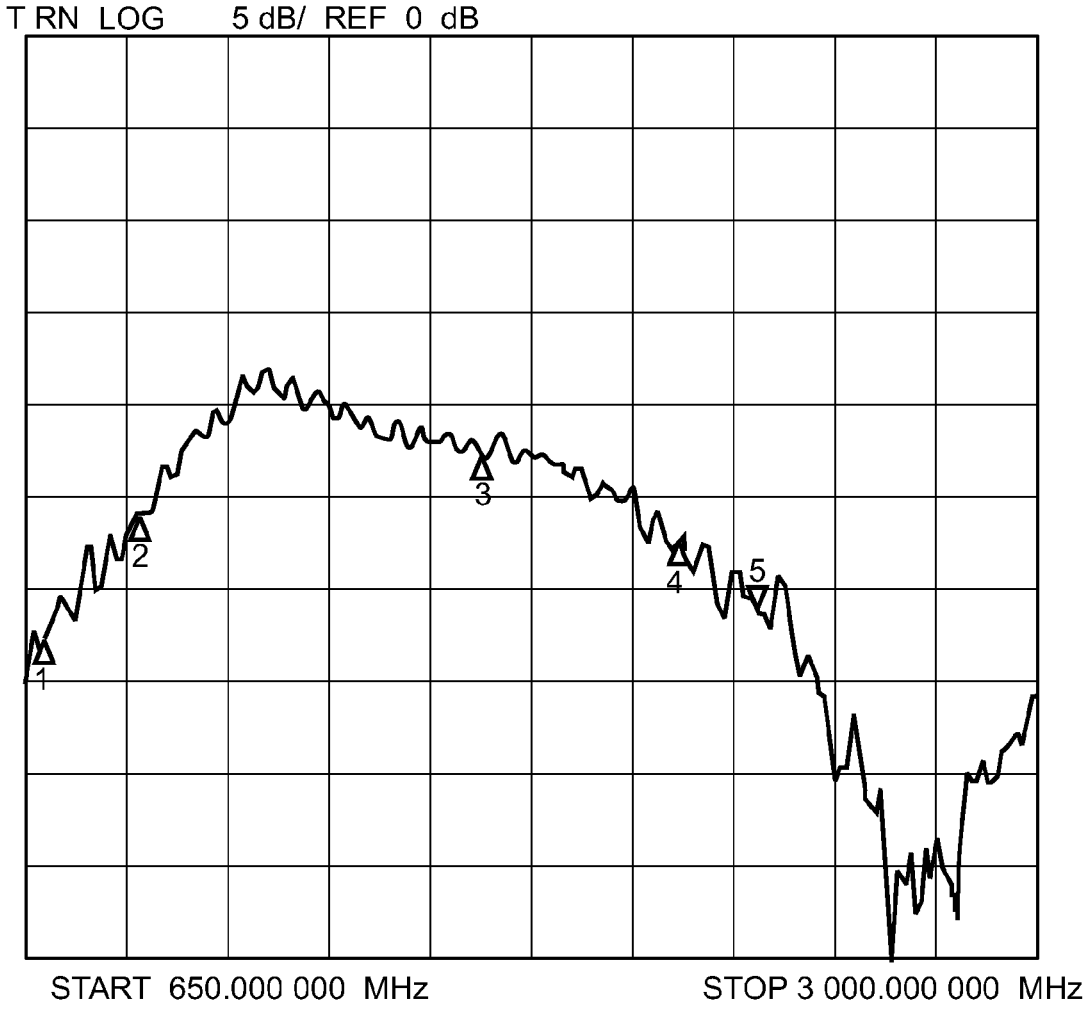
FIGS. 15-17 are exemplary graphs depicting isolation between antenna elements of an exemplary antenna assembly.
Figure 16:
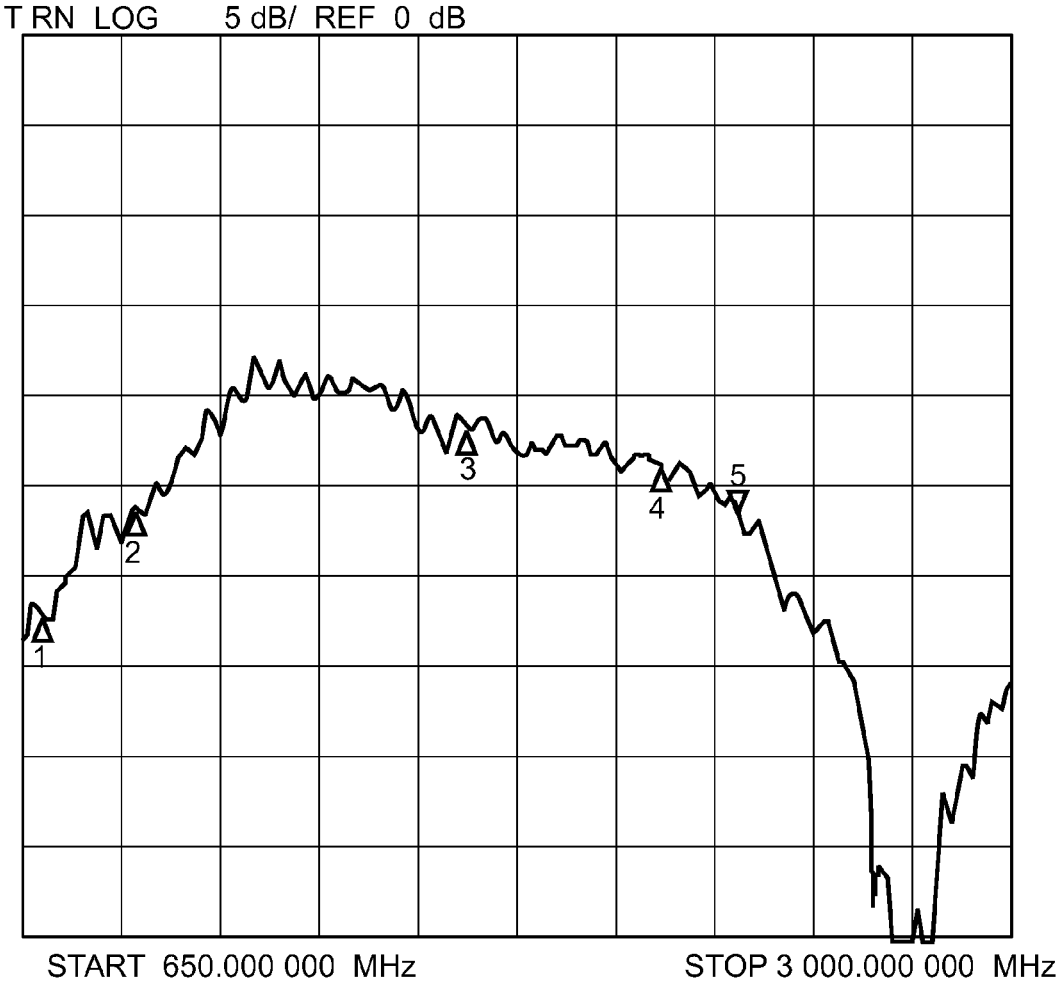
Figure 17:
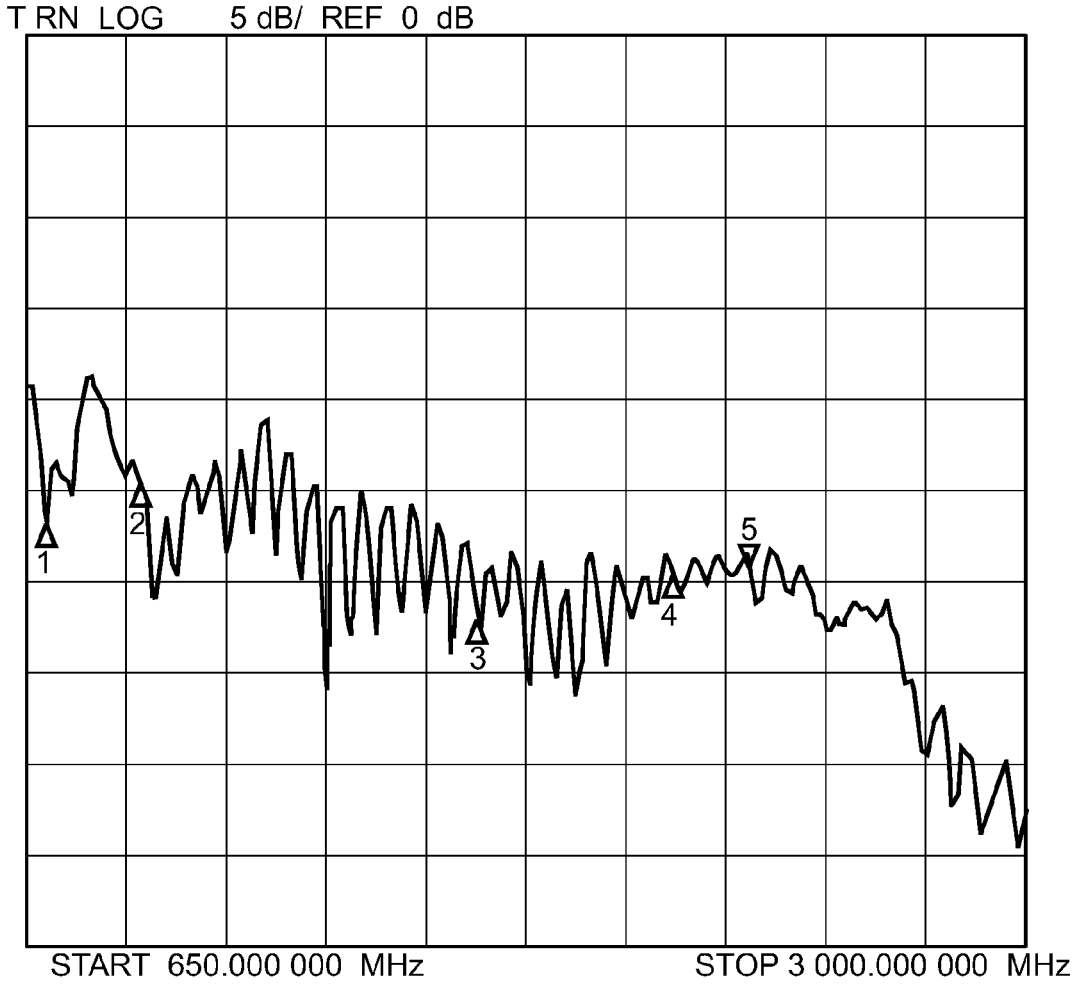

By etching the features 411 into the ground plane 420 (e.g. removing portions of the conductive material of the ground plane), isolation of the antenna elements 401, 403, and 405 is improved. Exemplary graphs depicting isolation between antenna elements 401, 403, and 405 over a frequency range of 650 MHz to 3 GHz are shown in FIGS. 15-17. In particular, FIG. 15 depicts isolation between antenna elements 401 and 403. FIG. 16 depicts isolation between antenna elements 403 and 405 and FIG. 17 depicts isolation between antenna elements 401 and 405. Each of FIGS. 15-17 includes 5 reference points or markers. Table 1 below summarizes the values represented by the reference points in the respective graphs.

TABLE 1

| | Marker 1 | Marker 2 | Marker 3 | Marker 4 | Marker 5 |
|---|---|---|---|---|---|
| FIG. 15 | −21.632 dB at 698 MHz | −19.530 dB at 920 MHz | −27.046 dB at 1.71 GHz | −24.542 dB at 2.17 GHz | −24.356 dB at 2.35 GHz |
| FIG. 16 | −27.134 dB at 698 MHz | −21.337 dB at 920 MHz | −16.803 dB at 1.71 GHz | −18.962 dB at 2.17 GHz | −21.477 dB at 2.35 GHz |
| FIG. 17 | −27.744 dB at 698 MHz | −20.993 dB at 920 MHz | −17.678 dB at 1.71 GHz | −22.287 dB at 2.17 GHz | −26.071 dB at 2.35 GHz |

It is to be understood that FIGS. 15-17 and the values in Table 1 are provided by way of example and not by way of limitation. In particular, actual measured isolation between any two antenna elements is dependent on the specific implementation of the antenna assembly. Such variables include the operation frequency, length of the features 411, and size of the antenna elements.

The features 411 depicted in FIGS. 4A-4C are provided for purposes of explanation. It is to be understood that characteristics of the features can be varied or modified in other embodiments. For example, the width of the features 411 can vary. Additionally, as shown in FIGS. 4A-4C, each of the features 411, in this embodiment, includes a first curved portion 413 and a narrower second curved portion 415 adjacent the first curved portion 413. The length, width, and location of each of the first and second curved portions can vary in other embodiments. In addition, the number of curved portions can vary. In addition, the features 411 are depicted as continuous etchings in this example. However, it is to be understood that in other embodiments, the etched portions of each feature 411 need not be continuous and can be separated by sections of conductive material.

As shown in FIG. 4A, one feature 411A includes a first curved portion 413A having a first width and a first length and a second curved portion 415A that is proximate to the first curved portion 413A. The second curved portion 415A has a second width and a second length. The second width is narrower than the first width. Another feature 411B includes a third curved portion 413B having a third width and a third length and a fourth curved portion 415B that is proximate to the third curved portion 413B. The fourth curved portion 415B has a fourth width and a fourth length. The fourth width is narrower than the third width. The curved portion 413A is without a linear segment as the curved portion 413A extends from a corresponding first point P1 to a corresponding second point P2. The curved portion 415A is without a linear segment as the curved portion 415A extends from a corresponding first point P1 to a corresponding second point P2. The curved portion 413B is without a linear segment as the curved portion 413B extends from a corresponding first point P1 to a corresponding second point P2. The curved portion 415B is without a linear segment as the curved portion 415B extends from a corresponding first point P1 to a corresponding second point P2. The ground plane has an outer edge that defines a perimeter of the ground plane. The outer edge has a radius of curvature. The curved portions have a corresponding radius of curvature that is less than a radius of curvature of the outer edge.

Figure 5:
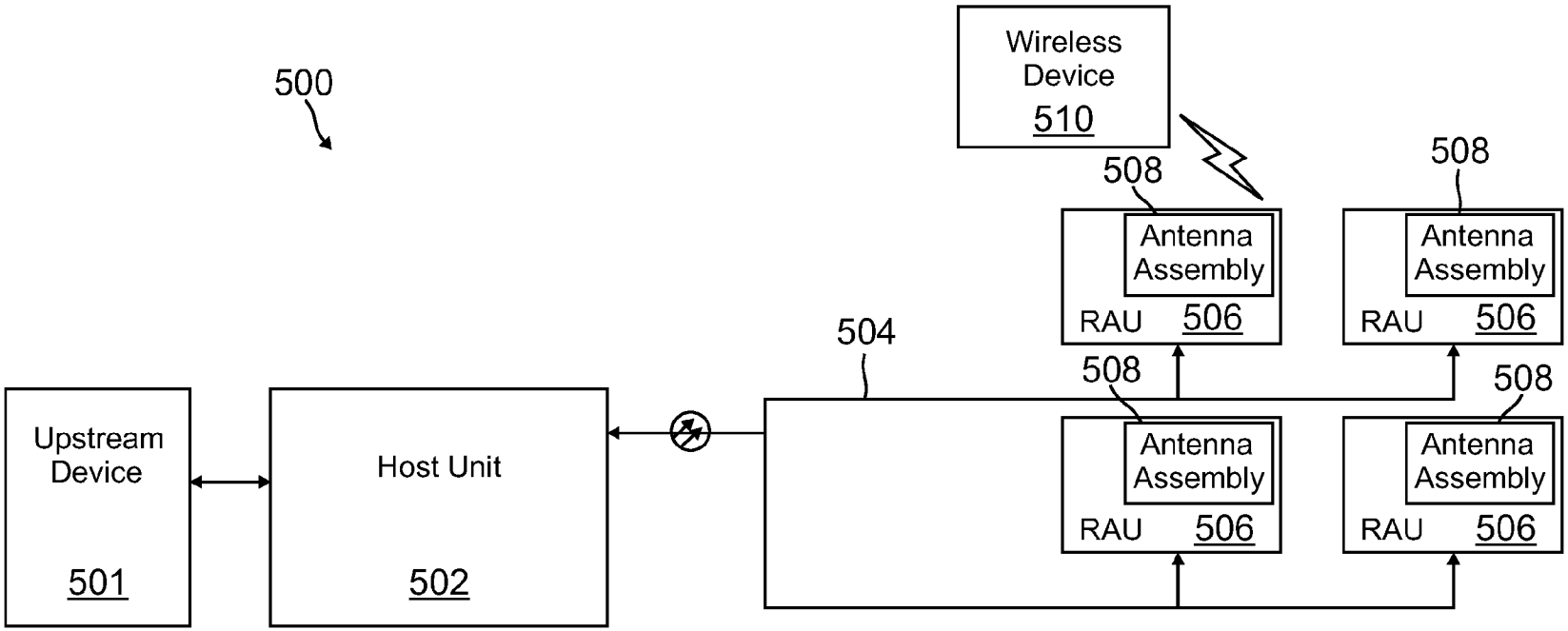
FIGS. 5 is a high level block diagram of one embodiment of an exemplary communication system.

FIG. 5 is a high level block diagram of one embodiment of an exemplary communication system 500 in which an antenna assembly such as antenna assembly 100 is implemented. System 500 is a distributed antenna system (DAS). However, it is to be understood that the embodiments of the antenna assembly described herein are not limited to implementation in a remote antenna unit of a DAS and can be used in other wireless communication systems. For example, embodiments of the antenna assembly can be implemented in base stations and repeater units, and in various communication systems, such as microcell and picocell cellular networks.

System 500 is a field configurable distributed antenna system (DAS) that provides bidirectional transport of a portion of radio frequency (RF) spectrum between an upstream network device 501 and a plurality of remote antenna units (labeled RAU in FIG. 5) 506. The network device 501 is a source of RF signals, such as a base station transceiver, wireless access point or other source of RF signals. System 500 can be implemented for use with various communication technologies including, but not limited to, a Public Switched Telephone Network (PSTN), a Global System for Mobile communications (GSM) network, a Universal Mobile Telecommunications System (UMTS) network, a Worldwide Interoperability for Microwave Access (WiMAX) network, a Wireless Broadband (WiBro) network, etc.

Along with network device 501 and the plurality of RAUs 506, system 500 includes a host unit 502, and a transport mechanism 504. The host unit 502, a modular host transceiver, is communicatively coupled to RAUs 506, modular remote radio heads. Notably, although only four RAUs 506 are shown in this example, for purposes of explanation, other numbers of RAUs 506 can be used in other embodiments. For example, in some embodiments, the host unit 502 supports up to eight RAUs 506. In addition, in some embodiments, one or more intermediary units can be optionally used between the RAUs 506 and the host unit 502. The intermediary units (also referred to as expansion hubs) increase the number of RAUs 506 supported by the host unit 502. For example, in one embodiment, up to eight RAUs 506 can be connected to each expansion hub and up to four expansion hubs can be coupled to the host unit 502.

The host unit 502 and RAUs 506 work together to transmit and receive data to/from respective antenna assemblies 508. In this embodiment, host unit 502 provides the interface between the network device 501 and a signal transport mechanism 504. Each of RAUs 506 provides the interface between the signal transport mechanism 504 and a respective antenna assembly 508. Each antenna assembly 508 is implemented using an antenna assembly such as antenna assembly 500 having a circuit board assembly such as circuit board assembly 400. In addition, although each RAU 506 includes a single antenna assembly 508 in this embodiment, more than one antenna assembly can be associated with each RAU 506 in other embodiments. For example, more than one antenna assembly 508 can be associated with each RAU 506 for implementation of multiple-input multiple-output (MIMO) technologies such as WiMAX.

In this embodiment, the signal transport mechanism 504 is an optical fiber, and the host unit 502 sends optical signals through the optical fiber to the RAUs 506. In some embodiments, a single optical fiber is used for both uplink and downlink transmissions. In other embodiments, one optical fiber is used for the uplink transmissions and another separate optical fiber is used for downlink transmission. In addition, in other embodiments, the signal transport mechanism 504 can be implemented using other media. For example, additional suitable implementations of the signal transport mechanism 504 include, but are not limited to, thin coaxial cabling or CATV cabling where multiple RF frequency bands are distributed or lower-bandwidth cabling, such as unshielded twisted-pair cabling, for example, where only a single RF frequency band is distributed.

During transmission, the network device 501 performs baseband processing on data and places the data onto a channel. In one embodiment, the network device 501 is an IEEE 802.16 compliant base station. Optionally, network device 501 may also meet the requirements of WiMax, WiBro, or a similar consortium. In another embodiment, network device 501 is an 800 MHz or 1900 MHz base station. In yet another embodiment, the system is a cellular/PCS system and network device 501 communicates with a base station controller. In still another embodiment, network device 501 communicates with a voice/PSTN gateway. The network device 501 also creates the protocol and modulation type for the channel. In packet networks, the network device 501 converts the packetized data into an analog RF signal for transmission via antenna assemblies 508.

The network device 501 sends the RF signal to host unit 502. The host unit 502 converts the analog RF signal to a digital serial data stream for long distance high speed transmission over transport mechanism 504. The host unit 502 sends the serial data stream over the signal transport mechanism 504, and the stream is received by one or more RAUs 506. Each RAU 506 converts the received serial data stream back into the original analog RF signal and transmits the signal over its corresponding antenna assembly 508 to consumer mobile devices 510 (for example, a mobile station, fixed wireless modem, or other wireless devices). In some embodiments, the upstream devices, such as network device 501, are a part of a telecommunication-service providers' infrastructure while the downstream devices, such as wireless devices 510, comprise customer premise equipment.

In addition, in some embodiments, the host unit 502 is directly physically connected to one or more upstream network devices 501. In other embodiments, the host unit 502 is communicatively coupled to one or more upstream devices in other ways (for example, using one or more donor antennas and one or more bi-directional amplifiers or repeaters). Furthermore, the host unit 502 and/or RAUs 506 may perform one or more of the following: filtering, amplification, wave division multiplexing, duplexing, synchronization, and monitoring functionality as needed.

Although specific embodiments have been illustrated and described herein, it will be appreciated by those of ordinary skill in the art that any arrangement, which is calculated to achieve the same purpose, may be substituted for the specific embodiments shown. For example, dimensions, types of materials, orientations of the various components, and the number and positions of the various components described herein are intended to define parameters of certain embodiments, and are by no means limiting and are merely exemplary embodiments. As used herein, the terms "first," "second," and "third," etc. are used as labels and are not intended to impose numerical requirements on their respective objects. Therefore, it is manifestly intended that this invention be limited only by the claims and the equivalents thereof.

What is claimed is:

1. An antenna assembly comprising:

a circuit board;

a ground plane embedded in the circuit board and comprised of a conductive material, the ground plane comprising a plurality of curved features etched into the ground plane, each of the curved features including a respective curved portion that is without a linear segment as the respective curved portion curves from a corresponding first point to a corresponding second point; and a plurality of antenna elements, each of the plurality of antenna elements mounted to the circuit board and coupled to the ground plane;

wherein each of the plurality of curved features etched into the ground plane is dimensioned to increase isolation between the plurality of antenna elements;

wherein the ground plane has an outer edge that defines a perimeter of the ground plane, each of the curved features including an open-ended slot that extends into the ground plane from the outer edge, the open-ended slots being open along the outer edge.

2. The antenna assembly of claim 1, wherein the plurality of antenna elements are mounted on the circuit board in a linear order.

3. The antenna assembly of claim 2, wherein the curved portions curve toward the antenna element that is located approximately in a center of the ground plane to provide isolation between the antenna elements.

4. The antenna assembly of claim 2, wherein the first antenna element and the third antenna element are configured with essentially the same size and shape.

5. The antenna assembly of claim 4, wherein each of the first antenna element and the third antenna element comprise:

a first element portion having a first end mounted to the substrate and a second end opposite the first end, the first element portion oriented about perpendicular to the substrate; and a second element portion extending from the second end of the first element portion, the second element portion oriented about perpendicular to the first element portion.

6. The antenna assembly of claim 5, wherein each of the first antenna element and the third antenna element comprises a plurality of slots in the first element portion.

7. The antenna assembly of claim 1, wherein the circuit board has a circular shape.

8. The antenna assembly of claim 1, wherein the plurality of antenna elements comprises three antenna elements.

9. The antenna assembly of claim 1, wherein each of two of the plurality of antenna elements comprises:

a first element portion having a first end mounted to the circuit board and a second end opposite the first end, the first element portion oriented about perpendicular to the circuit board; and a second element portion extending from the second end of the first element portion, the second element portion oriented about perpendicular to the first element portion.

10. The antenna assembly of claim 9, wherein the first element portion of each of the two antenna elements has a length of about 60 mm and a width of about 65 mm; and wherein the second element portion of each of the two antenna elements has a width of about 65 mm and length of about 10 mm;

wherein the plurality of antenna elements includes an antenna element that is positioned between the two antenna elements and has a length of about 35 mm and a width of about 32 mm.

11. The antenna assembly of claim 1, wherein each of the curved features has a length equal to approximately a quarter wavelength of electromagnetic radiation radiated from at least one of the antenna elements to provide isolation between the antenna elements.

12. The antenna assembly of claim 1, wherein the ground plane has outer edge a radius of curvature, the curved portions having a corresponding radius of curvature that is less than a radius of curvature of the outer edge.

13. The antenna assembly of claim 1, wherein the plurality of antenna elements include first, second, and third antenna elements mounted on the circuit board in a linear order, the second antenna element being approximately halfway between the first and third antenna elements, wherein the curved features curve toward the second antenna element.

14. The antenna assembly of claim 1, wherein the curved portion includes only a single curve.

15. The antenna assembly of claim 1, wherein each of the curved features includes a plurality of separate curved portions, each of the curved portions of a corresponding curved feature curving in a common direction.

16. The antenna assembly of claim 1, wherein the curved features include first and second curved features, the first and second curved features curving toward each other.

17. The antenna assembly of claim 16, wherein the plurality of antenna elements include first, second, and third antenna elements mounted on the circuit board in a linear order, the second antenna element being approximately halfway between the first and third antenna elements and between the second points of the first and second curved features.

18. The antenna assembly of claim 1, wherein the open-ended slots comprise:

a first open-ended slot having a first width and a first length;

a second open-ended slot proximate to the first open-ended slot, the second open-ended slot having a second width and a second length, the second width being narrower than the first width;

a third open-ended slot having a third width and a third length; and a fourth open-ended slot proximate to the third open-ended slot, the fourth open-ended slot having a fourth width and a fourth length, the fourth width being narrower than the third width.

19. The antenna assembly of claim 18, wherein each of the open-ended slots has a length equal to approximately a quarter wavelength of electromagnetic radiation radiated from at least one of the antenna elements to provide isolation between the antenna elements.

20. An antenna assembly comprising:

a circuit board;

a ground plane embedded in the circuit board and comprised of a conductive material, the ground plane comprising a plurality of curved features etched into the ground plane, each of the curved features including a respective curved portion that is without a linear segment as the respective curved portion curves from a corresponding first point to a corresponding second point; and a plurality of antenna elements, each of the plurality of antenna elements mounted to the circuit board and coupled to the ground plane;

wherein each of the plurality of curved features etched into the ground plane is dimensioned to increase isolation between the plurality of antenna elements;

wherein the plurality of curved features comprises:

a first portion having a first width and a first length;

a second portion proximate to the first portion, the second portion having a second width and a second length, the second width being narrower than the first width;

a third portion having a third width and a third length; and a fourth portion proximate to the third portion, the fourth portion having a fourth width and a fourth length, the fourth width being narrower than the third width.

21. The antenna assembly of claim 20, wherein the ground plane has an outer edge that defines a perimeter of the ground plane, each of the curved features including an open-ended slot that extends into the ground plane from the outer edge, the open-ended slots being open along the outer edge.

22. The antenna assembly of claim 20, wherein each of two of the plurality of antenna elements comprises:

a first element portion having a first end mounted to the circuit board and a second end opposite the first end, the first element portion oriented about perpendicular to the circuit board; and a second element portion extending from the second end of the first element portion, the second element portion oriented about perpendicular to the first element portion.

23. The antenna assembly of claim 20, wherein each of the curved features has a length equal to approximately a quarter wavelength of electromagnetic radiation radiated from at least one of the antenna elements.

24. The antenna assembly of claim 20, wherein the ground plane has a radius of curvature, the curved portions having a corresponding radius of curvature that is less than a radius of curvature of the outer edge.

25. The antenna assembly of claim 20, wherein the plurality of antenna elements include first, second, and third antenna elements mounted on the circuit board in a linear order, the second antenna element being approximately halfway between the first and third antenna elements, wherein the curved features curve toward the second antenna element.

26. The antenna assembly of claim 25, wherein the curved portions curve toward the second antenna element.

27. The antenna assembly of claim 20, wherein the curved portion includes only a single curve.

28. The antenna assembly of claim 20, wherein each of the curved features includes a plurality of separate curved portions, each of the curved portions of a corresponding curved feature curving in a common direction.

29. The antenna assembly of claim 20, wherein the curved features include first and second curved features, the first and second curved features curving toward each other.

30. The antenna assembly of claim 29, wherein the plurality of antenna elements include first, second, and third antenna elements mounted on the circuit board in a linear order, the second antenna element being approximately halfway between the first and third antenna elements and between the second points of the first and second curved features.

* * * * *